US006070427A

United States Patent [19]

Fine et al.

[11] Patent Number: 6,070,427

[45] Date of Patent: Jun. 6, 2000

[54] METHOD FOR SHIPPING EXOTHERMIC MATERIALS

[75] Inventors: Brett M. Fine, Matawan; Bruce E. Kurtz, Lebanon, both of N.J.

[73] Assignee: National Starch and Chemical Investment Holding Corporation, Wilmington, Del.

[21] Appl. No.: 08/948,550

[22] Filed: Oct. 10, 1997

[51] Int. Cl.[7] ..... F25D 3/08

[52] U.S. Cl. ..... 62/371; 62/457.2; 62/372

[58] Field of Search ..... 62/371, 457.2, 62/372

[56] References Cited

U.S. PATENT DOCUMENTS

| | | | |
|---|---|---|---|
| 4,377,075 | 3/1983 | Russo | 62/372 |
| 4,530,816 | 7/1985 | Douglas-Hamilton | 422/1 |
| 4,903,493 | 2/1990 | Van Iperen et al. | 62/60 |
| 5,355,684 | 10/1994 | Guice | 62/54.2 |

*Primary Examiner*—Henry Bennett
*Assistant Examiner*—M Shulman
*Attorney, Agent, or Firm*—Eugene Zagarella, Jr.

[57] ABSTRACT

A shipping and storage system for exothermic materials where the risk of reaching unacceptably high temperatures is alleviated comprising, a) a container vessel, b) a heat sink material inside the vessel and adapted to hold and be in intimate contact with one or more packages of exothermic material, the heat sink material having an effective high heat capacity and latent heat of melting and/or vaporization such that it absorbs all of the energy produced by the exothermic material, if it reacts by reaching its reaction initiation temperature, and c) optional cooling means in the vessel and surrounding the heat sink material and packaged exothermic material.

9 Claims, 4 Drawing Sheets

METHOD FOR SHIPPING EXOTHERMIC MATERIALS

BACKGROUND OF THE INVENTION

This invention relates to a package system and container apparatus and a method of shipping exothermic materials.

Many chemical compositions and formulations are packaged, stored and shipped to customers in various manners and modes of transportation. Some of these products involve materials which are exothermic and can react and liberate significant amounts of heat when they reach temperatures at or above ambient or room temperature. One product group of this type is premixed chemical formulations used in electronic and aerospace adhesive applications. These formulations are typically highly reactive epoxies consisting of a resin and hardener which are combined together at the point of manufacture and sold in syringes or other sample containers as a single homogeneous material. These materials can react rapidly if they reach their reaction initiation temperature and liberate a significant amount of heat. In order to prevent premature reaction and curing, the materials are cooled to very low temperatures which greatly slow or completely suppress the polymerization reaction. These premixed and frozen formulations can be safely stored in a freezer or other suitable temperature controlled device without the risk of liberating heat. When the formulations are needed, they can be removed from cold storage and allowed to warm to room temperature where they can be applied and allowed to react. This form of product is often desired by customers since they simply have to thaw and use it, as opposed to having to mix chemicals at their manufacturing facility.

The main problem with premixed and frozen exothermic materials, as described above, is that they are extremely difficult and potentially dangerous to store for extended periods of time outside a freezer. Furthermore, they are difficult to ship using conventional means (e.g., standard non-refrigerated trucks, airplanes etc.). Because they have the potential of liberating significant amounts of heat if they reach a certain ambient temperature, they must be packed in some cooling or other medium, such as dry ice, to keep the temperature below that which is needed for reaction. However, even these systems are limited by the thermal mass of the coolant and the insulating efficiency of the package and can only extend the time that the products can be stored or shipped without external refrigeration. In cases where the material does reach the necessary temperature for reaction and significant heat liberation, there is the possibility of thermal destruction of the outer shipping container. In order to alleviate such a problem, the U.S. Department of Transportation currently requires that exothermic type materials must be shipped in special temperature controlled environments. This requirement is imposed because of the potential for the coolant to completely dissipate over time due to the insulating inefficiency of the outer package. This causes heat release from the exothermic material and destruction of the outer package. Currently, exothermic materials cannot be transported by air because of the potential for "self-heating" to excessively high temperatures and ground transport is limited to shipment in special temperature controlled containers.

The prior art discloses many different shipping and packaging systems using heat sink materials and other coolant and temperature control means. For example, U.S. Pat. No. 5,355,684 issued Oct. 18, 1994 to W. Guice, discloses a system for the storage and shipment of frozen and chilled biological materials consisting of a cryogenically insulated vessel containing a heat sink material. U.S. Pat. No. 4,903,493 issued Feb. 27, 1990 to W. Van Iperen et al. discloses the use of heat sink materials for protecting thermolabile goods such as thermometers. U.S. Pat. No. 4,530,816 issued Jul. 23, 1985 to D. Douglas discloses a method and apparatus for cooling, preserving and safely transporting biological materials using a container with cooling and thermal insulating means.

The prior art, exemplified above, has disclosed many different shipping and packaging systems with cooling and other protective means. These shipping and packaging systems are used to preserve the materials being shipped by temporarily mitigating the affect of heat entering from outside the package. However, the difficulty of handling exothermic materials and the underlying problem of additional and significant heat liberation inside the package has not been dealt with.

Accordingly, the object and purpose of this invention is to provide a safe shipping and storage system for exothermic materials where the risk of reaching unacceptably high temperatures during shipping and storage is alleviated or significantly mitigated.

SUMMARY OF THE INVENTION

The present invention provides a shipping and storage container for exothermic material wherein the container is adapted to maintain the temperature at or below ambient temperature or the maximum safe shipping temperature comprising:

a) a vessel b) a heat sink material inside the vessel and adapted to hold and be in intimate contact with one or more packages of exothermic material, the heat sink material having an effective heat capacity and latent heat of melting and/or vaporization such that it absorbs all of the energy given off by the exothermic material if it reacts by reaching its reaction initiation temperature, and c) optional cooling means in the vessel and surrounding the heat sink material and packaged exothermic material.

Another embodiment of this invention involves a method of shipping and storing exothermic materials while avoiding excessive high temperatures comprising:

a) providing a vessel, b) providing within the vessel a heat sink material with effective heat capacity and latent heat of melting and/or vaporization, and c) packaging exothermic material and placing it in one or more openings in the heat sink material in such a manner that it is in intimate contact with the heat sink material, and wherein all the energy given off by the exothermic material during shipping and storage, if it reacts by reaching its reaction initiation temperature, is absorbed by the heat sink material and the temperature inside the vessel is maintained at or below ambient temperature.

DETAILED DESCRIPTION OF THE INVENTION

This invention involves a package system for safely shipping and storing exothermic materials without external cooling. The term "exothermic" material as used herein denotes a material which can react and liberate significant amounts of heat when it reaches temperatures at or above certain ambient temperatures. Such exothermic materials can be safely stored and shipped if maintained at cooled temperatures below the temperature at which such materials react and give off large amounts of heat. However, even if the materials are frozen or cooled, it is difficult to maintain and store them for extended periods of time without external cooling means (such as a refrigerated truck) because such systems are usually limited by the thermal mass of the coolant, the insulating efficiency of the package and natural or environmental conditions. The problem associated with unfrozen or uncooled exothermic products is more than just thawing or spoiling as in the case of food products and biological systems, but rather excessive heat liberation and possible thermal destruction of the entire package and damage to the surroundings.

Figure 3:
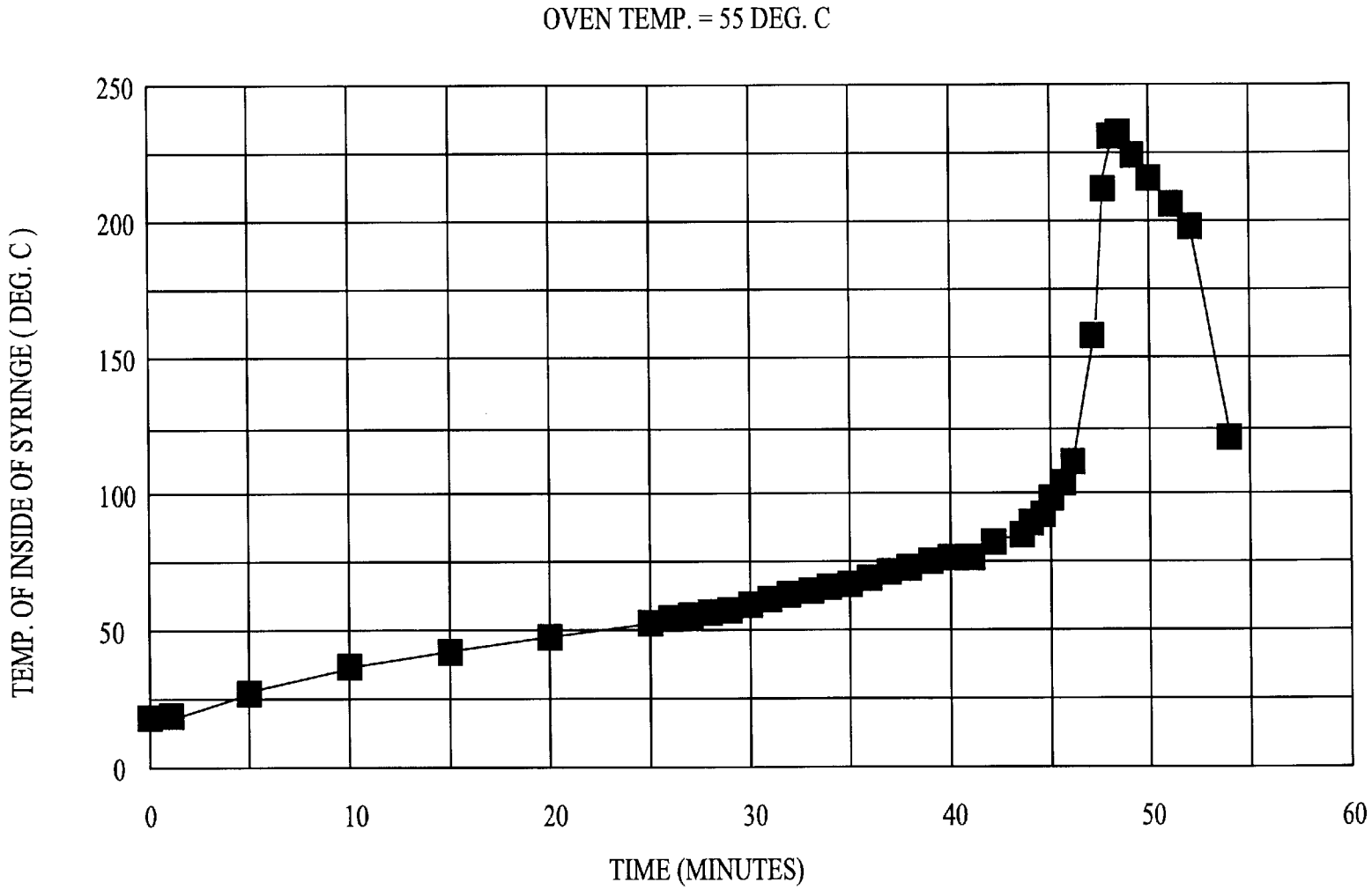
FIG. 3 represents a graphical representation showing a temperature profile of sample exothermic material without the heat sink material.

The effect of excess heat generated by a sample of exothermic material is graphically illustrated in FIG. 3. This figure shows the temperature profile of an unpackaged exothermic material sample (30 cc syringe of epoxy formulation) with a heat of reaction of about 300 joules/gram when heated to a temperature of about 55° C. As noted because of the internal heat generated by the material after it exceeded its reaction initiation temperature, the sample temperature increased all the way to about 230° C. This not only damages the sample material but also would probably cause thermal destruction of any outer shipping container and represent an unsafe and unacceptable shipping procedure.

In order to avoid the problems of excessive heat generated by exothermic materials, it is necessary to have a packaging system which prevents the internal temperature of the package from rising above a certain suitable ambient temperature or maximum safe shipping and storage temperature. This suitable ambient or maximum safe shipping and storage temperature is typically about 100° C. or lower and preferably about 55° C. or lower and will vary depending on the local laws regulating safe shipping temperatures, requirements of the shipper and the ability of the outer package to withstand elevated temperatures. The U. S. Department of Transportation (D.O.T.) has required that the internal packaging temperature of packages containing exothermic material of the type illustrated by the sample shown in FIG. 3 will not go above 55° C. In order to determine if the internal temperature of the package will exceed the maximum desired temperature, a self-accelerating decomposition temperature (SADT) test is conducted. This SADT test is provided by the D.O.T. (United States SADT testing protocol 28.4.1 Series H).

The package system of this invention satisfies the requirement of maintaining a maximum safe shipping temperature by employing a selected heat sink martial. The heat sink material as used in this invention has an effective high heat capacity and latent heat of melting and/or vaporization such that it absorbs all of the energy that may be produced by the exothermic material if it reaches its reaction initiation temperature. It must absorb all the heat liberated by the reaction of the exothermic material up to the maximum or ceiling ambient temperature suitable for safe transportation or storage. As noted above, the heat sink material has a latent heat of melting. This allows the material to change phases from a solid to a liquid, preferably at a temperature just below the maximum temperature at which the package is to be maintained or controlled and more preferably about two to three degrees below the maximum acceptable temperature. It is also preferred that the heat sink material is a solid and changes phases from solid to liquid. However, the heat sink material could be a liquid and have a corresponding latent heat of vaporization which allows it to change phases from a liquid to a gas. Alternatively, the heat sink material could be of suitable nature that it causes two phase changes, that is from a solid to a liquid and then to a gas. The overall objective would be to for such material to absorb all the energy given off by the exothermic material, if it reaches its reaction initiation temperature, and thereby maintain the container package temperature at or below its maximum desired temperature. If the heat sink is designed to change phases, the outer package should be designed to retain the material in either phase or slowly releases the phase change material in an acceptable manner. Suitable heat sink material having the above attributes include various hydrocarbons, petroleum and plastic materials and eutectic salts. Particularly useful heat sink materials are waxes and preferably paraffin wax.

Besides the composition of the heat sink material, in order to prevent the temperature of the exothermic material from rising above the maximum desired ambient temperature, the design and structure of the heat sink material is also important. It is desired to physically structure the heat sink material so that it is in intimate contact or relatively close to the exothermic material. Additionally, a sufficient and effective amount of heat sink material should be put around the exothermic material to completely absorb any exotherm heat generated. If the minimum amount of heat sink material is used, it should be adapted to be evenly distributed around the exothermic material, such as in a radial or circumferential manner. This allows the heat to dissipate from the exothermic material in an even or equal manner. Finally, when there is more than one package or sample holder of exothermic material in the heat sink material block, they should be evenly spaced from each other so as to evenly distribute the dissipated heat and to insulate the heat from other exothermic material packages in the same container or package system.

Figure 1:
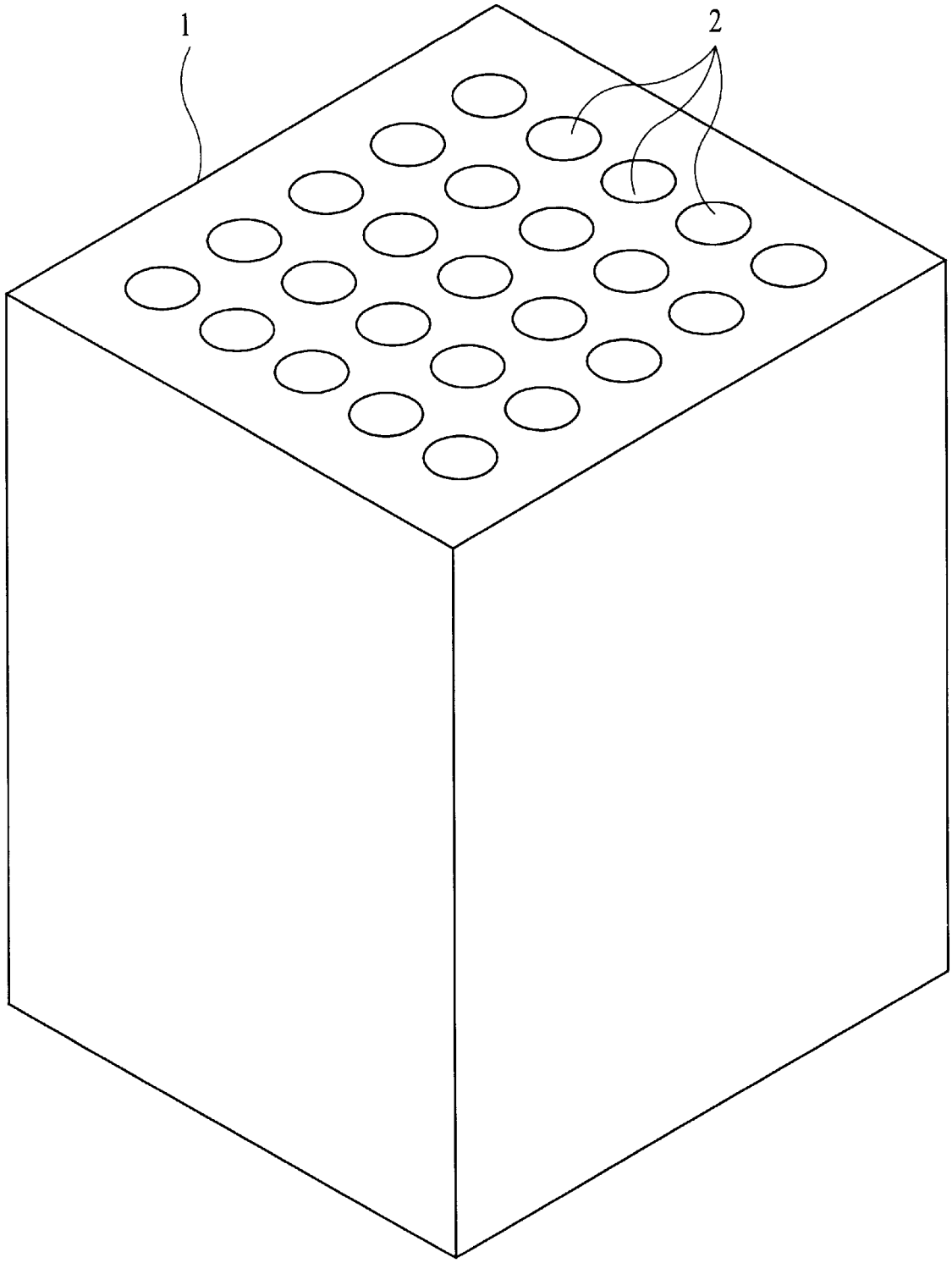
FIG. 1 is a perspective view showing a block of heat sink material with openings for sample materials as used in this invention.

FIG. 1 shows a block 1 of heat sink material which has a plurality of openings or holes 2 drilled or formed in the block to hold a series of packages, syringes or other exothermic material holders. The openings 2 are evenly distributed throughout the heat sink block 1 and adapted so that the exothermic material holders placed therein are in relatively intimate contact at their outer surface with such heat sink material and block.

Figure 2:
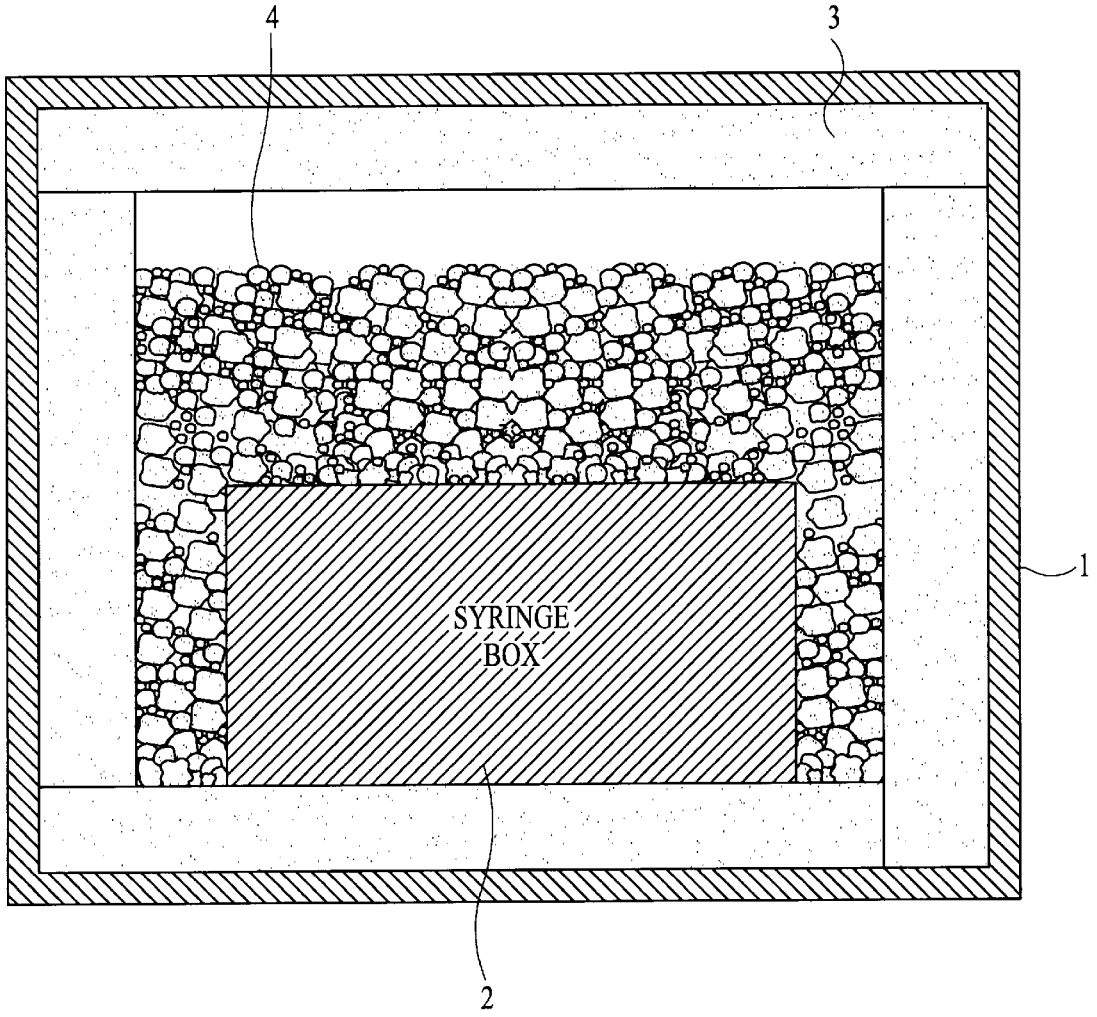
FIG. 2 illustrates schematically one embodiment of the package and container system of this invention.

FIG. 2 shows a schematic design of a preferred embodiment of the package system used with heat sink. The heat sink block, shown as syringe box 2, is placed, inserted or fitted in an outer container or vessel 1 which is insulated 3 and further filled or adapted with coolant means 4.

Figure 4:
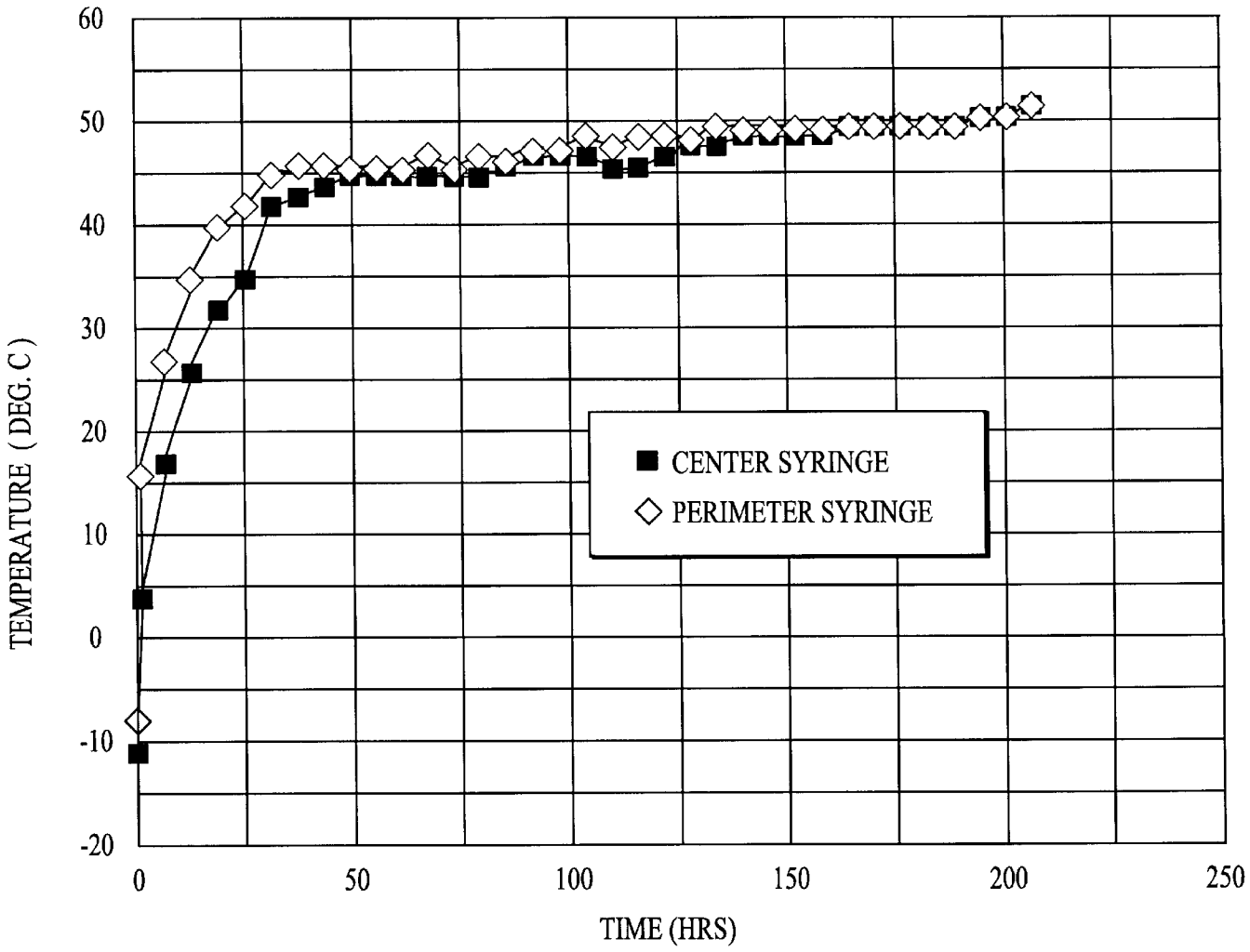
FIG. 4 represents a graphical representation showing a temperature profile of sample exothermic material contained in the package system of this invention.

FIG. 4 shows a plot of temperature data for syringe sample holders (30 cc) containing exothermic material (same epoxy formulation as sample used in FIG. 3 illustration) and placed in a wax block of heat sink material as shown in FIG. 1 and heated in an oven to 55° C. The block is then placed in a package system shown schematically in FIG. 2. FIG. 4 shows temperature data for the center syringe as well as for a perimeter syringe. Both curves exhibit a steep temperature increase in the first 30 hours of the test. The temperatures then level off dramatically at about 46° C. and increase slowly over the next 170 hours. The initial temperature rise is caused by heat entering from outside the container package and from heat generated inside from the syringes. The rate of temperature increase is dramatically reduced as the phase transition temperature of the wax heat sink material is reached. The transition begins at about 46° C. and is complete at about 52° C. At no point during this test procedure did either syringe temperature exceed the 55° C. maximum ambient temperature. This contrasts with the effects of the test shown in FIG. 3, described above, where a syringe of exothermic material that was not placed in a block of exothermic material (unpackaged) was heated in an oven at 55° C. In that test, the syringe sample temperature increased all the way to 230° C. because of the internal heat generated by the exothermic material. This is an unacceptably high temperature and particularly is unsuitable for air transport. This comparison shows the advantageous affects of using the package system of this invention which prevents the contents of the package from exceeding a maximum and suitable ambient temperature.

In a preferred embodiment, the package system of this invention as shown in FIG. 2 is constructed using a standard outer box 1 of cardboard or similar material. The outer box is insulated 3 with a Styrofoam chest or other suitable insulation or insulated enclosure which has sufficient room for the heat sink material or block, shown as syringe box 2, and coolant means 4 such as dry ice. It is noted that the outer box or vessel may or may not be insulated. The heat sink material is a solid with high heat capacity and a high latent heat of melting. The heat sink material must have combined heat absorption properties so that when present in sufficient mass, it will be able to absorb the total quantity of heat liberated if the exothermic material begins to react. The heat sink material will have a melting point two or three degrees below the maximum acceptable ambient shipping temperature. This temperature can vary depending on the local shipping laws, requirements of the carrier, and the ability of the package to withstand high temperatures. The heat sink material is preferably paraffin wax and is formed into a block as shown in FIG. 1 with holes or compartments for inserting exothermic material or containers with exothermic compounds in them. The holes shall be formed to allow for intimate contact of the exothermic material along the majority of its exposed surface area. The heat sink block is preferably cooled to a temperature at or below the temperature of the coolant prior to inserting the exothermic material into the block. The heat sink block with the exothermic material inside, is sealed in a plastic bag, or other suitable container, for the purpose of retaining any phase change liquid. Sufficient room shall be left in the phase change retention container to hold the entire mass of phase change material in the liquid form.

The heat sink block with the exothermic material inside and the liquid retention container around the block is placed inside the insulated container. A suitable coolant such as dry ice is placed in the open space left in the insulated container which is then covered with a lid made of the same material. It is noted that the heat sink block or material may be removably placed within the container or vessel, that is, it may be fixed or placed in the container as a removable unit. It is additionally noted that the heat sink material or block may also be housed within a separate box or enclosure which can then be placed within the container.

What is claimed is:

1. A shipping and storage container for exothermic material which is adapted to maintain the temperature of the container at or below ambient temperature or the maximum safe shipping and storage temperature comprising:

a) an insulated vessel;

b) a heat sink material inside the vessel and adapted to hold, be in intimate contact with and be evenly distributed around one or more packages of exothermic material, the heat sink material is a solid material selected from the group consisting of hydrocarbons, petroleum, plastic materials and eutectic salts and has an effective heat capacity and a latent heat of melting just below the maximum temperature at which the container is maintained such that it absorbs all of the energy given off by the exothermic material if it reacts by reaching its reaction initiation temperature; and, c) optional cooling means in the vessel and surrounding the heat sink material and packaged exothermic material.

2. A method of shipping and storing exothermic material while avoiding excessively high temperatures comprising:

a) providing an insulated vessel;

b) providing a heat sink material within the vessel and which is adapted to be evenly distributed around the packages of exothermic material, the heat sink material is a solid material selected from the group consisting of hydrocarbons, petroleum, plastic materials and eutectic salts and has an effective heat capacity and a latent heat of melting just below the maximum temperature at which the container is maintained; and, c) packaging exothermic material and placing it in one or more openings in the heat sink material in such a manner that it is in intimate contact with the heat sink material and wherein all the energy given off by the exothermic material during shipping and storage, if it reacts by reaching its reaction initiation temperature, is absorbed by the heat sink material and the temperature is maintained at or below ambient or maximum safe shipping and storage temperature.

3. The container of claim 1 wherein the heat sink material is paraffin wax.

4. The container of claim 1 wherein the heat sink material is in the form of a solid block having a uniform series of openings for placement of packages of exothermic material.

5. The container of claim 1 wherein the heat sink material is paraffin wax and the maximum temperature at which the container is maintained is about 55° C. or lower.

6. The method of claim 2 wherein the temperature at which the container is maintained is about 100° C. or lower.

7. The method of claim 2 wherein the heat sink material is paraffin wax.

8. The method of claim 7 wherein the heat sink material is in the form of a solid block having a uniform series of openings for placement of packages of exothermic material.

9. The method of claim 2 wherein the temperature to which the container is maintained is about 55° C. or lower.

* * * * *